US007857234B2

(12) United States Patent
Daley et al.

(10) Patent No.: US 7,857,234 B2
(45) Date of Patent: Dec. 28, 2010

(54) REMOTE SHOWER ACTUATION AND TEMPERATURE SENSING UNIT

(75) Inventors: Robert D Daley, Pittsburgh, PA (US); Henry F. Thorne, West View, PA (US)

(73) Assignee: Thorley Industries LLC, Pittsburgh, PA (US)

( * ) Notice: Subject to any disclaimer, the term of this patent is extended or adjusted under 35 U.S.C. 154(b) by 970 days.

(21) Appl. No.: 11/681,266

(22) Filed: Mar. 2, 2007

(65) Prior Publication Data

US 2008/0060707 A1 Mar. 13, 2008

Related U.S. Application Data

(60) Provisional application No. 60/779,052, filed on Mar. 3, 2006.

(51) Int. Cl.
*G05D 23/13* (2006.01)
*G05D 7/00* (2006.01)

(52) U.S. Cl. ..... 236/12.12; 236/12.1; 700/282

(58) Field of Classification Search ..... 236/12.1, 236/12.12, 94; 137/624.22; 29/729; 700/282
See application file for complete search history.

(56) References Cited

U.S. PATENT DOCUMENTS 4,281,543 A 8/1981 Raz
4,353,139 A 10/1982 Wainwright et al.
4,432,635 A 2/1984 Mayer
4,994,792 A * 2/1991 Ziegler, Jr. ..... 340/584
5,172,860 A 12/1992 Yuch
5,535,779 A 7/1996 Huang
5,845,844 A * 12/1998 Zosimodis ..... 236/12.12
5,979,776 A * 11/1999 Williams ..... 236/12.12
5,984,195 A * 11/1999 Benedict ..... 236/12.2
6,028,509 A 2/2000 Rice
6,059,192 A * 5/2000 Zosimadis ..... 236/12.12
6,158,227 A 12/2000 Seeley
6,286,764 B1 * 9/2001 Garvey et al. ..... 236/12.12
6,314,807 B1 11/2001 Kawai et al.
6,427,260 B1 8/2002 Osborne-Kirby
6,519,790 B2 2/2003 Ko
6,805,458 B2 10/2004 Schindler et al.
6,871,540 B2 3/2005 Barlian et al.
6,892,745 B2 5/2005 Benson
6,892,807 B2 5/2005 Fristedt et al.
6,892,952 B2 5/2005 Chang et al.
2002/0002739 A1 1/2002 Demonet
2003/0125842 A1 7/2003 Chang et al.
2003/0156620 A1 8/2003 Wang (Continued)

*Primary Examiner*—Chen-Wen Jiang
(74) *Attorney, Agent, or Firm*—The Webb Law Firm

(57) ABSTRACT

A remote shower actuator and temperature sensing unit installs in a shower having a shower head in a water line that is downstream of hot and cold water mixing for the shower. The shower actuator includes a battery powered wireless actuated blocking valve, a digital temperature sensor mechanism, a temperature indicating mechanism and generally two independent one wireless controllers. The valve may move between a closed position, an open position and a trickle flow position. The trickle flow position is a significantly reduced flow in response to a potentially hazardous temperature reading. The temperature indicating mechanism may be a visible display on the controllers that constantly displays the measured temperatures, or may be a visible or audible indicator on the controllers that identifies that the flowing water temperature has reached an acceptable steady state temperature, or a combination of the two.

15 Claims, 3 Drawing Sheets

U.S. PATENT DOCUMENTS

2003/0202558 A1 10/2003 Chung et al.
2005/0121529 A1* 6/2005 DeLangis ..... 236/12.12
2006/0045167 A1 3/2006 Pawlenko et al.
2006/0118645 A1 6/2006 An
2006/0227847 A1 10/2006 Johnson
2006/0227850 A1 10/2006 Johnson

* cited by examiner

REMOTE SHOWER ACTUATION AND TEMPERATURE SENSING UNIT

RELATED APPLICATION

This application claims the benefit of U.S. provisional patent application bearing Ser. No. 60/779,052 filed Mar. 3, 2006 and entitled "Remote Shower Actuation and Temperature Sensing Unit".

BACKGROUND OF THE INVENTION

1. Field of the Invention

The present invention relates to a remotely controllable shower actuation and temperature sensing unit. More particularly the present invention is directed to an after market shower blocking valve having plural remote wireless controllers, digital temperature sensing, temperature display and/or temperature indicating mechanism and temperature responsive safety shut off.

2. Background Information

In a typical shower, when the shower is first engaged the temperature of the water coming from the shower is generally far less than ideal, even shockingly cold. Consequently, it is not unusual for the user to reach in from outside the shower enclosure and turn on the water and then stand back and wait for the shower to reach an acceptable temperature. It would be advantageous if the users could remotely start the shower to avoid reaching into the shower enclosure at the inception of the shower.

Shower user's will often start the shower and wait far more time than is required for the shower to reach a steady state temperature, as entering the shower before the water temperature has reached a minimal comfort temperature can be less than desirable. This excessive waiting by the user results in a large waste in water, a waste in the energy needed to heat the water, and a waste of the user's time. It would be advantageous if the user could be informed when the running shower has reached a desired temperature. This would save on water, energy and on overall time for the user.

A further issue for many people in taking showers is the precise mixture of hot and cold water necessary to obtain the desired shower water temperature. Many people have a relatively narrow preferred temperature range for the shower water that is desired, and this range often varies from individual to individual. This personal preference will manifest itself in a relatively standard position for the mixing valve(s) for the hot and cold water going to the shower head. In other words, relative position of the mixing valve(s) from a user's shower to shower in any particular shower enclosure will typically remain the same for each individual. If this relative position can be more easily replicated from shower to shower for the particular shower enclosure, it will save the additional time that user's take for tweaking the valve positions at the beginning of a shower to adjust the temperature back to their own personal preferred water temperature. It would, therefore, be advantageous if the relative mixing valve(s) positions could be simply and efficiently replicated from shower to shower for any given shower enclosure.

Another issue associated with showers is the dangers of a sudden change in water temperature during a shower. A sudden temperature spike may occur from a lack of cold water supply due to other activated cold water uses in the system (e.g. starting of a washing machine, flushing of a toilet, etc). The sudden temperature spike can result in dangerous scalding conditions within the shower. Further, the sudden temperature change can be startling for the user resulting in a greater likelihood of the user slipping within the shower enclosure and injuring him or her, which is particularly true for elderly or infirm users. Sudden temperature drops may also pose similar consequences of startling the user. It would be advantageous if the shower could address unacceptable extreme temperature variations in the water temperature.

A further issue in addressing shower improvements is that solutions that require substantive re-plumbing of the shower are simply not practical to most individuals and would not be implemented. In other words, improvements in conventional shower efficiency, operation or safety that require the hiring of a licensed plumber would not be widely adopted and would therefore be largely ineffective. There is a particular need for shower related improvements to be easily implemented into existing shower enclosures.

It is the objects of the present invention to address the deficiencies of the prior art discussed above and to do so in an efficient cost effective manner.

SUMMARY OF THE INVENTION

It is noted that, as used in this specification and the appended claims, the singular forms "a," "an," and "the" include plural referents unless expressly and unequivocally limited to one referent.

For the purposes of this specification, unless otherwise indicated, all numbers expressing any parameters used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention.

All numerical ranges herein include all numerical values and ranges of all numerical values within the recited numerical ranges. The numerical ranges and parameters setting forth the broad scope of the invention are approximations, but are reported as precisely as possible.

The various embodiments and examples of the present invention as presented herein are understood to be illustrative of the present invention and not restrictive thereof and are non-limiting with respect to the scope of the invention.

According to one non-limiting embodiment of the present invention addressing at least one of the above stated objects, a shower actuator is provided for a shower having a shower head in a water line that is downstream of hot and cold water mixing for the shower. The shower actuator includes a battery powered wireless actuated blocking valve, a digital temperature sensor mechanism, a temperature indicating mechanism and at least one wireless controller. The blocking valve is configured to be placed in the water line down stream of the mixing of hot and cold water for the shower with the blocking valve moveable between at least a closed position in which the mixed hot and cold water stream is prevented from exiting the shower head, and an open position in which the mixed hot and cold water stream is substantially unimpeded by the blocking valve from flowing to the shower head. The digital temperature sensor mechanism is positioned within the water line down stream of the mixing of hot and cold water for the shower and configured to measure the temperature of water flowing in the water line. The temperature indicating mechanism communicates with the digital temperature sensor mechanism and indicates to the user at least one measured temperature of the water when the blocking valve is not in the closed position. The wireless controller communicates with the blocking valve and is configured to send signals to the blocking valve to move the valve at least between the open and the closed positions.

According to one non-limiting embodiment of the present invention addressing at least one of the above stated objects, a shower actuator is provided for a shower having a shower head in a water line that is downstream of hot and cold water mixing for the shower. The shower actuator includes a battery powered wireless actuated blocking valve, a wireless controller and at least one other independent controller for moving the blocking valve. The blocking valve is configured to be placed in the water line down stream of the mixing of hot and cold water for the shower. The blocking valve is moveable between at least a closed position in which the mixed hot and cold water stream is prevented from exiting the shower head, and an open position in which the mixed hot and cold water stream is substantially unimpeded by the blocking valve from flowing to the shower head. The wireless controller communicates with the blocking valve and is configured to send signals to the blocking valve to move the valve at least between the open and the closed positions. The other independent controller is also configured for moving the blocking valve at least between the open and the closed positions.

According to one non-limiting embodiment of the present invention addressing at least one of the above stated objects, a shower actuator is provided for a shower having a shower head in a water line that is downstream of hot and cold water mixing for the shower. The shower actuator includes a digital temperature sensor mechanism, a battery powered actuated blocking valve, and at least one controller for moving the blocking valve. The digital temperature sensor mechanism is positioned within the water line down stream of the mixing of hot and cold water for the shower and configured to measure the temperature of water flowing in the water line. The battery powered blocking valve is configured to be placed in a shower down stream of the mixing of hot and cold water for the shower. The blocking valve is moveable between at least a closed position in which the mixed hot and cold water stream is prevented from exiting the shower head, an open position in which the mixed hot and cold water stream is substantially unimpeded by the blocking valve from flowing to the shower head, and a trickle flow position in which the mixed hot and cold water stream is substantially but not completely impeded by the blocking valve from flowing to the shower head wherein water continues to flow in an amount sufficient for the digital temperature sensor mechanism to obtain an accurate temperature reading of the flowing water. The digital temperature sensor mechanism will send a signal to the blocking valve to move the valve to the trickle flow position in response to a measured temperature of the water which is at least above a preset maximum temperature value. The controller is configured for moving the blocking valve at least between the open and the closed positions.

These and other advantages of the present invention will be clarified in the description of the preferred embodiments taken together with the attached figures.

DESCRIPTION OF THE PREFERRED EMBODIMENTS

Figure 1:
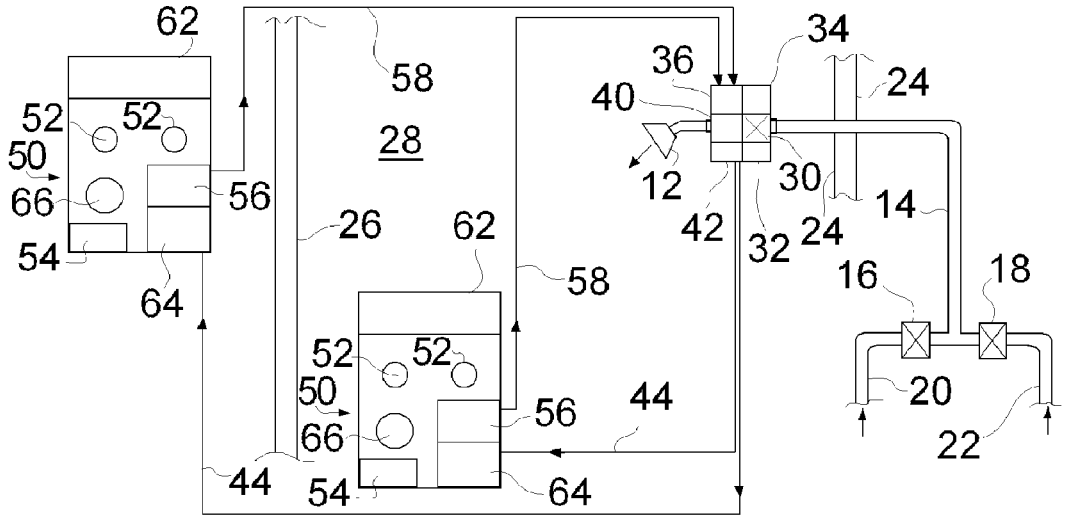
FIG. 1 is a schematic illustration of a remotely controllable or accessed shower actuation and temperature sensing unit installed in a shower according to one aspect of the present invention.
Figure 2:
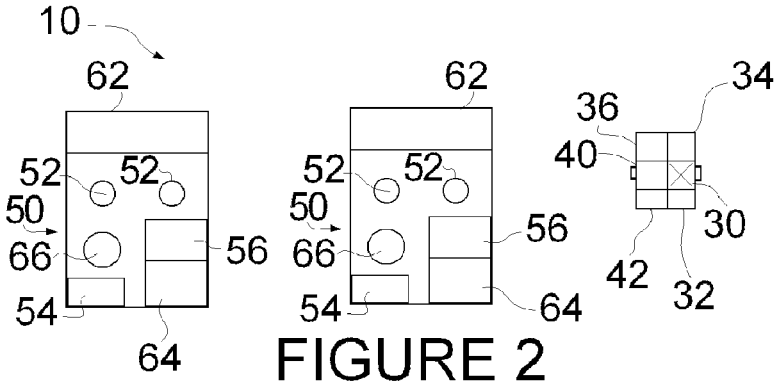
FIG. 2 is a schematic illustration of the remotely accessed shower actuation and temperature sensing unit of FIG. 1.

FIGS. 1 and 2 schematically illustrate one embodiment of a remotely controllable or accessed shower actuation and temperature sensing unit 10 installed in a shower according to one aspect of the present invention. The remote controlled shower actuator and temperature sensing unit 10, shown individually in FIG. 2, installs in a conventional shower having a shower head 12 in a water line 14 that is downstream of hot and cold water mixing for the shower. The mixing of the hot and cold water can be through separate mixing valves 16 and 18 in the cold water supply line 20 and the hot water supply line 22, or through a common single mixing valve (not shown) as well known in the art. The water line 14, and mixing valves 16 and 18, will typically extend through the wall 24 forming part of the shower enclosure 28. A barrier 26, which is typically moveable such as a door or curtain to form a user access, will bound one portion of the typical shower enclosure 28 that is not bounded by the wall 24. The moveable barrier 26 can be a shower curtain that is generally aligned with one side of a bath tub in a shower/tub combination, or a sliding or pivoting door as found in shower stalls. The barrier 26 may merely be an open access for the user to enter the enclosure 28 with a lip on the floor to maintain the shower water in the shower enclosure. The present invention is not intended to be restricted to any particular structure for a shower or a shower enclosure 28, the variety of which enclosures are essentially endless. The details of the shower enclosure 28 are illustrated merely to provide an important environmental context to the present invention.

The shower actuator 10 includes a battery powered wireless actuated blocking valve 30 that is configured to be placed in the water line 14 down stream of the mixing of hot and cold water for the shower enclosure 28 and upstream of the shower head 12. Any conventional watertight coupling can be used, but threaded attachments are generally preferred for easily incorporating the blocking valve into the water line 14. The blocking valve 30 is moveable between a closed position in which the mixed hot and cold water stream in the water line 14 is prevented from exiting the shower head 12, an open position in which the mixed hot and cold water stream in the water line 14 is substantially unimpeded by the blocking valve 30 from flowing to the shower head 12, and a trickle flow position described in greater detail below. The closed position is essentially a sealed, leak proof valve position which can stop the flow of water through the shower head 12 even with the mixing valves 16 and 18 fully open. The open position is essentially a "fully open" position, although the flow may be minimally impeded valve internal bore or valve construction itself (e.g. the bore diameter through the valve 30 may be slightly smaller than the diameter of the water line 14), but not in any way that would hinder the intended operation of the shower head 12. This is what is referred to as substantially unimpeded flow. Other than the trickle flow position described below, the present invention does not require any particular variation in water flow through the valve 30, which is generally on or off rather than a flow regulating valve, such as mixing valves 16 and 18.

The trickle flow position for the valve 30 is a significantly reduced flow position for the valve 30 in response to a potentially hazardous temperature reading as will be described. The significantly reduced flow is preferably reduced to a minimal amount that is sufficient for an accurate temperature reading of the flowing water, typically about a 90% or more reduction in flow from the fully open position. The purpose of the trickle flow position is to have the flow cease coming out of the shower head 12 in force with a trajectory toward the user, but rather to have it generally fall substantially vertically from the shower head 12. The stopping of the substantial flow is intended to prevent the scalding or startling effects of a forceful stream of water at a hazardous temperature. Allowing a trickle of flow to continue allows the temperature to be monitored so that the unit 10 can have a reading of when the water temperature is no longer in the danger zone and the valve can then be returned to the fully open position. It is likely that wide temperature variations will occur only for a minimal duration, and the shower will resume when the water temperature has returned. If the interruption is longer than a minimum time the trickle of water flow in will act as an indicator to the user that the shower is in the safe mode and the user will be visually prompted by the trickling flow of water to turn off the shower by moving the valve to the closed position wherein the trickling water flow will stop. Consequently the trickle flow also minimizes the likelihood the user will walk away from the shower when the shower is in the safe mode.

The valve 30 is an electrically actuated valve with a battery power supply 32 and an associated actuator 34. Any particular valve structure that can be moved to the three identified positions can be used. The battery power supply 32 is preferred in that it allows the unit 10 to be an efficient after market product. Powering the valve 30, actually the actuator 34, with other than battery power supply 32 would make simple consumer installation difficult in the shower enclosure 28 environment. Using manual actuation only for the valve 30, such as commonly used in valves 16 and 18, prevents the remote actuation, which is a fundamental aspect of the present invention. A wireless receiver 36 is provided configured to receive a control signal for moving the valve 30 at least between the open and closed positions is also provided to allow for remote actuation. Conventional wireless coupling technology can be used for the receiver 36. The valve 30, actuator 34, battery 32, and receiver 36 can be collectively referenced as the valve 30.

The shower actuator 10 includes a digital temperature sensor mechanism 40 that is configured to be placed in the water line 14 down stream of the mixing of hot and cold water for the shower enclosure 28 and upstream of the shower head 12. Generally the digital temperature sensor mechanism 40 is adjacent to the valve 30, and may be considered as being incorporated or integrated into the valve 30 as they share a common housing. The digital temperature sensor mechanism 40 will have a conventional digital temperature measurement sensor in contact with the flow of water in the water line 14 to obtain a temperature reading of the flowing water. Preferably the digital temperature sensor mechanism 40 operates to obtain and send temperature measurements only when the valve 30 is not closed. The digital temperature sensor mechanism 40 is used for measuring the water temperature that can be conveyed to the user as described below, and is used to signal the actuator 34 to move the valve 30 into and out of the trickle flow position in response to a hazardous temperature reading. For example potential scalding temperature of greater than 120 degrees Fahrenheit may be used as an upper bound that will trigger the trickle flow position. An extremely cold water temperature, such as below 60 degrees Fahrenheit may also be used as a set point to trigger the trickle flow. If a cold set point is also desired for the unit 10, then modifying code may be added in which the trickle flow position for cold temperature is not triggered unless there is a sensed drop in the water temperature, to allow for shower to be turned on and warmed up to the shower temperature without triggering the trickle flow. Consequently, the effective use of a cold set point for the trickle flow actuation may require additional memory, relative timing and comparative abilities than the anti-scalding set point, such that using only an anti-scalding implementation is somewhat easier. Although implementing the digital temperature sensor mechanism 40 to accomplish both extreme hot and cold trickle flow actuations is believed to be within the purview of one of ordinary skill in the art.

A conventional digital temperature sensor is preferred because of the rapid response time needed to be effective in this application. A digital temperature sensor will provide an accurate reading in less than a second. Analog sensors and/or displays will have a too great of a lag time to be effective in this application. The digital temperature sensor mechanism 40 communicates with a wireless transmitter 42 that will communicate the sensed temperature to a temperature indicating mechanism through a control signal 44. The temperature indicating mechanism, in unit 10, is integrated into each of two independent wireless controllers 50.

Two wireless controllers 50 are provided to control the valve 30 and incorporate a temperature indicating mechanism to provide temperature feedback to the user as will be described. The plurality of the controllers 50 are preferred as two controllers allows them to be wall mounted or otherwise strategically placed both within and outside of the shower enclosure 28. The controllers 50 need not be stationary, and each may be constructed as a portable controller 50. In order to provide the greatest potential flexibility to the users, the controllers 50 may be formed with a detachable mounting unit that can secure each controller in a horizontal (e.g. countertop or table top) or vertical (e.g. wall, shower enclosure door) position. In this manner the individual controllers 50 can be mounted in desired stationary locations, such as one inside the shower enclosure 28 and one outside the shower enclosure 28, as shown. Detaching the controllers from the associated mounting unit would allow the user to have a portable controller as desired, which may be beneficial to care providers.

The controllers 50 have user engaged controls 52 for operation of the valve 30. The controls 52 can be push buttons, an on-off lever or switch, a touch screen, a dial, or other conventional actuator. Each wireless controller 50 is preferably powered through a battery 54, as such a power source will be more acceptable for use inside the shower enclosure 28 and maintains the possibility of portability for the controllers 50, and complete independence for placement of the controllers 50 (i.e. the controllers 50 need not be positioned close to a power outlet). The controls 52 cooperate with a wireless transmitter 56 which communicates with the receiver 36 to send a control signal 58 to the receiver 36 for moving the valve 30 to the open or to the closed position. It is the digital temperature sensor mechanism 40 that communicates with the actuator 34 to move the valve 30 into and out of the safety trickle flow position described above, as this position is in response to dangerous sensed temperatures (or temperatures that are no longer dangerous when the valve is moved out of the trickle flow position).

As described above the controllers 50 have a temperature indicating mechanism integrated therein. The temperature indicating mechanism will convey the measured water temperature to the user. The temperature indicating mechanism includes a digital display 62 that will continuously display the measured water temperature when the water is flowing, and will preferably display nothing when water is not flowing through the valve 30. The digital display 62 cooperates with the digital temperature sensing mechanism 40 to provide a rapid response for accurate temperature readings. The digital display 62 is coupled to a receiver 64 that receives a signal 44 from the transmitter 42 indicative of the measured temperature.

The temperature indicating mechanism includes a speaker 66 that can be used to convey that the water temperature has reached a desired temperature. Specifically, after the receiver 64 has received signals that indicates that the temperature has reached a steady state within an acceptable range (e.g. such as between 80 and 115 degrees), the speaker 66 can beep or otherwise audibly indicate that the shower temperature has been reached. The speaker 66 can also be activated with an alarm when the trickle flow has been actuated to warn the user. The precise control system for determining when a steady state temperature has been reached can be a determination that the measured water temperature is within an acceptable variation, such as plus or minus 1 or 2 degrees, from the previous one, two, or several measured comparison temperature values. The control logic for such a system is believed to be well within the skill of one of ordinary skill in the art associated with temperature sensing. The temperature indicating mechanism includes the speaker 66, the receiver 64 and the digital display 62. The controller 50, which includes the power supply 54, the transmitter 56 and the controls 52, and also be considered to include the temperature indicating mechanism that, in this embodiment, is integrated therein.

In operation the user merely pushes the buttons or controls 52 on one of the controllers 50 that will send a signal 58 from transmitter 56 to receiver 36 to have the actuator 34 move the valve 30 to the open position. It is anticipated that this controller 50 will be outside of the shower enclosure 28, possibly outside of the bathroom altogether. After initial installation of the unit 10, the mixing valves 16 and 18 will have been left open at the desired temperature from the previous shower. In other words the mixing of the hot and cold water will have already been precisely set for the user from the prior shower. Even if used by another user previously the mixing valve settings are likely to be close to a user's desired temperature. Consequently with the valve 30 opened, the water with the appropriate mixture (at steady state) of hot and cold water will begin in the line 14. The digital temperature sensor mechanism 40 will begin measuring the temperature of the water flow and send measurements to the digital display 66 via the transmitter 42, signal 44 and receiver 64. When it has been determined that a steady state temperature has been reached, the speaker 66 emits an audible alarm that may be a beep, a voice or other known audible indicators. In this manner the user knows exactly when the shower has reached the desired temperature and need not be constantly viewing the display 62. Following the alarm or indication from the speaker 66, the user can glance at the digital display 62 to assure the water temperature is acceptable. Once in the shower the user can make minor adjustments to the water temperature with small manipulations of the mixing valves 16 and 18 in the conventional fashion, however it is expected that the valves 16 and 18 will stay in substantially the same desired shower position for the user. Regardless, after making such adjustments, the new positions for the valves 16 and 18 will likely remain for the next shower. At the end of the shower the user will again push the buttons or controls 52 on one of the controllers 50 that will send a signal 58 from transmitter 56 to receiver 36 to have the actuator 34 move the valve 30 to the closed position, without the need to alter the desired mixing valve positions. The second controller 50 mounted within the shower enclosure 28 allows the user to turn off the shower from within the shower enclosure 28, while leaving the second controller 50 outside of the shower enclosure 28 (such as if both are primarily used as stationary wall mounted controllers).

The safety features of the trickle flow actuation are automatic as described above. This safety feature will only be actuated if an unsafe temperature condition is sensed. In such case the shower will effectively cease, only allowing such water to flow as is necessary to continue to measure the temperature of the water such that the system can measure when the water temperature has returned to a an acceptable level and the normal water flow is resumed.

Figure 3:
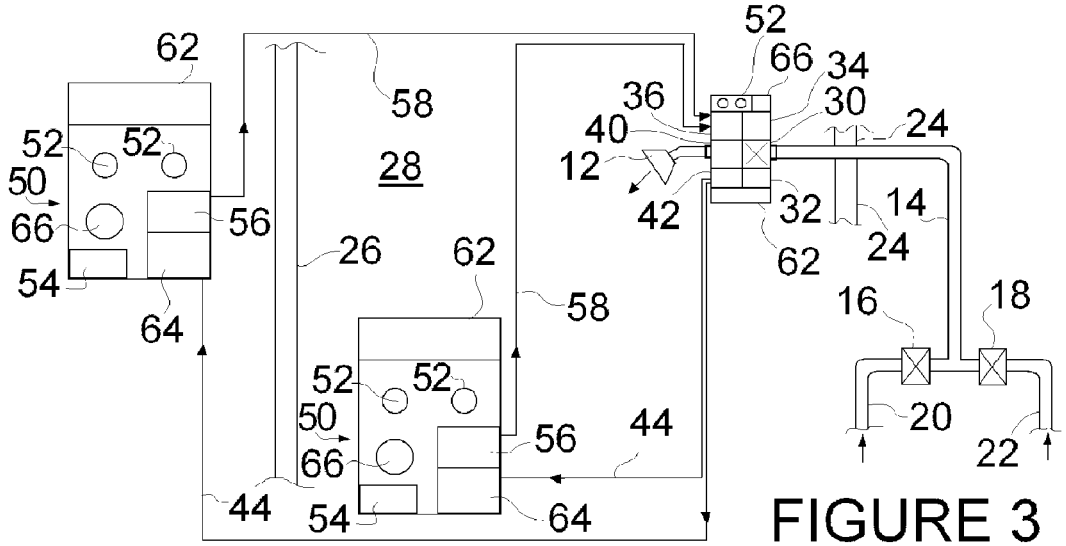
FIG. 3 is a schematic illustration of a remotely accessed shower actuation and temperature sensing unit installed in a shower according to another aspect of the present invention.
Figure 4:
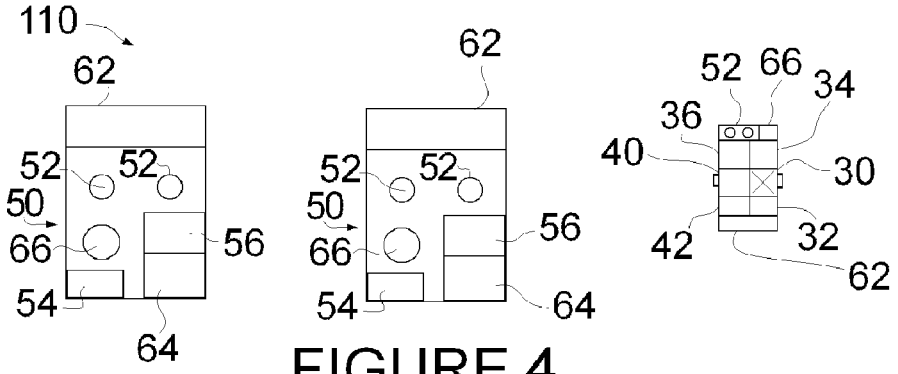
FIG. 4 is a schematic illustration of the remotely accessed shower actuation and temperature sensing unit of FIG. 3.

FIGS. 3 and 4 schematically illustrate one embodiment of a remotely accessed shower actuation and temperature sensing unit 110 installed in a shower according to one aspect of the present invention. FIGS. 3 and 4 illustrate a modification of the unit 10 shown in FIGS. 1 and 2. The unit 110 is identical to the unit 10 except that a digital display 62, audible speakers 66 and controls 52 are incorporated directly on the structure holding the valve 30. The placement of these elements on the structure of the valve 30 can minimize the need for a second controller 50 that would be placed inside the shower enclosure 28. It should be appreciated that the controls 52, display 62 and the speaker 66 that are incorporated into the structure holding the valve 30 no longer require wireless communication links, but outside of this distinction these elements operate in the same manner described above. Namely controls 52 are used to move the valve 30 between the open and closed positions, and the display 62 and the speaker 66 are used to convey at least one measured temperature to the user. Even in this embodiment the second wireless controller 50 mounted within the shower enclosure 28 can be beneficial to those users that cannot easily reach or interact with the structure holding the valve 30 (which will typically be over 6 feet off of the ground).

Figure 5:
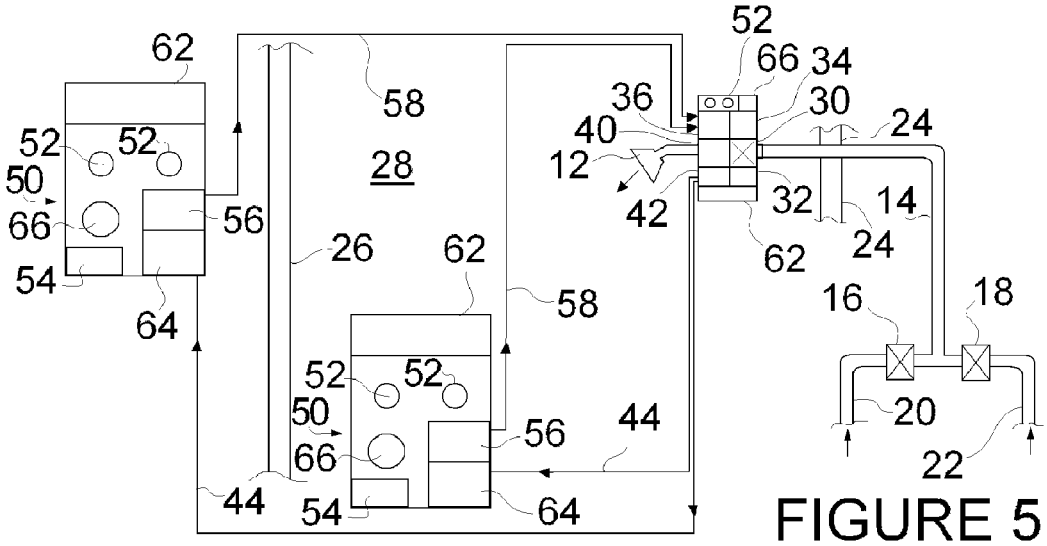
FIG. 5 is a schematic illustration of a remotely accessed shower actuation and temperature sensing unit installed in a shower according to another aspect of the present invention.
Figure 6:
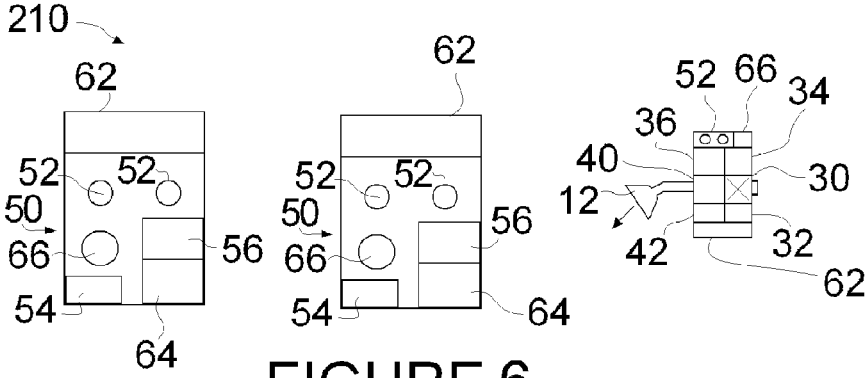
FIG. 6 is a schematic illustration of the remotely accessed shower actuation and temperature sensing unit of FIG. 1.

FIGS. 5 and 6 schematically illustrate one embodiment of a remotely accessed shower actuation and temperature sensing unit 210 installed in a shower according to one aspect of the present invention. FIGS. 5 and 6 illustrate a modification of the unit 110 shown in FIGS. 3 and 4. The unit 210 is identical to the unit 110 except that the shower head 12 is integral with the structure holding the valve 30. Essentially this unit 210 is constructed as a replacement shower head rather than a valve that is installed upstream of an existing shower head.

Figure 7A:
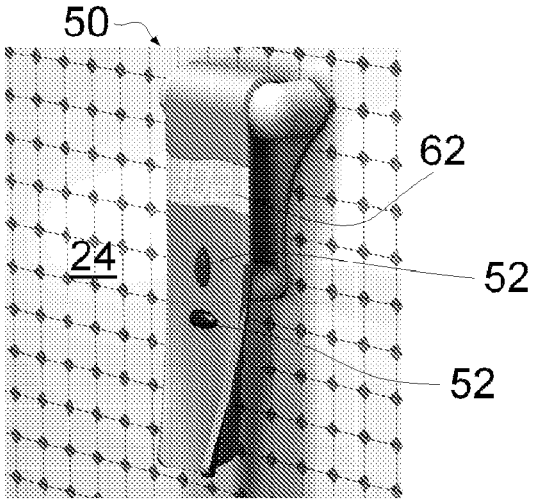
FIGS. 7A-C are perspective views of detachable wall mounted controllers for the remotely accessed shower actuation and temperature sensing units of the present invention.
Figure 7B:
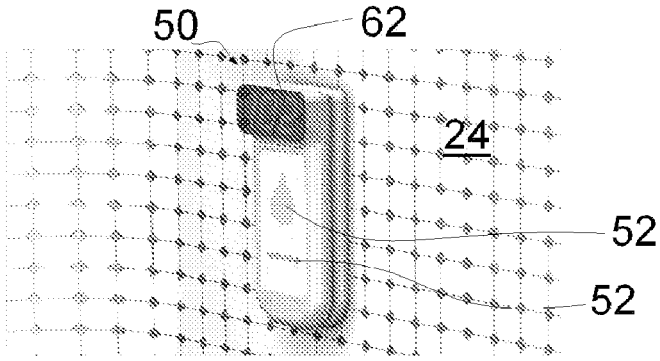
Figure 7C:
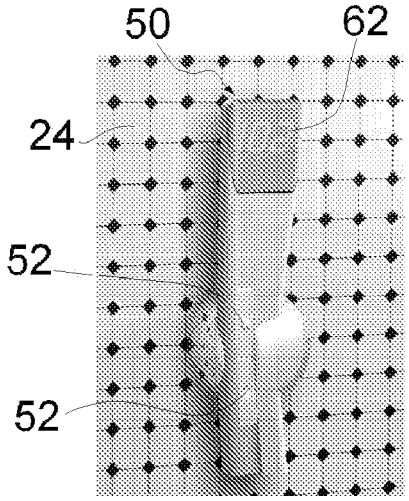

FIGS. 7A-C are perspective views of various implementations of detachable wall mounted controllers 50 for the remotely accessed shower actuation and temperature sensing units 10, 110 and/or 210 of the present invention. Parents of teenagers will appreciate the possibilities offered with detachable controllers 50 for minimizing the length of a teenager's otherwise seemingly endless shower. Through simply taking possession of all the controllers 50, at least with unit 10 that does not have independent controls 52 integrated into the valve 30, a parent can stop an overly lengthy shower with ease and without impinging on the privacy of the one taking the shower. Even with units 110 and 210, the parents' interruption of the shower, which could be restarted through activation of controls 52 on the valve 30, will send a not so subtle message that the user should be quickly wrapping up shower time.

Whereas particular embodiments of this invention have been described above for purposes of illustration, it will be evident to those skilled in the art that numerous variations of the details of the present invention may be made without departing from the invention as defined in the appended claims. The scope of the present invention is intended to be defined by the appended claims and equivalents thereto.

What is claimed is:

1. A shower actuator for a shower having a shower head in a water line that is downstream of hot and cold water mixing for the shower, the shower actuator comprising:

A) a battery powered wireless actuated blocking valve configured to be placed in the water line down stream of the mixing of hot and cold water for the shower, the blocking valve moveable between at least i) a closed position in which the mixed hot and cold water stream is prevented from exiting the shower head, and ii) an open position in which the mixed hot and cold water stream is substantially unimpeded by the blocking valve from flowing to the shower head;

B) a digital temperature sensor mechanism positioned within the water line down stream of the mixing of hot and cold water for the shower and configured to measure the temperature of water flowing in the water line;

C) a temperature indicating mechanism communicating with the digital temperature sensor mechanism and indicating to the user at least one measured temperature of the water when the blocking valve is not in the closed position, the temperature indicating mechanism comprising an audible indicator on at least one wireless controller that are adapted to convey when the measured temperature of the water reaches an acceptable steady state temperature at least when the valve is in the open position; and D) at least one wireless controller communicating with the blocking valve and configured to send signals to the blocking valve to move the valve at least between the open and the closed positions, wherein the valve is further moveable to a trickle flow position in which the mixed hot and cold water stream is substantially, but not completely, impeded by the blocking valve from flowing to the shower head wherein water continues to flow in an amount sufficient for the digital temperature sensor mechanism to obtain an accurate temperature reading of the flowing water, and the digital temperature sensor mechanism will send a signal to the blocking valve to move the valve to the trickle flow position in response to a measured temperature of the water above a preset maximum temperature value at least when the valve is in the open position.

2. The shower actuator according to claim 1 wherein the temperature indicating mechanism includes a visible display on at least one wireless controller adapted to continuously display the measured temperature of the water at least when the valve is in the open position.

3. The shower actuator according to claim 1 wherein the acceptable steady state temperature is between preset minimums and maximum temperatures.

4. The shower actuator according to claim 1 further including at least one controller which is independent of the at least one wireless controller for moving the blocking valve at least between the open and the closed positions.

5. A shower actuator for a shower having a shower head in a water line that is downstream of hot and cold water mixing for the shower, the shower actuator comprising:

A) a battery powered wireless actuated blocking valve configured to be placed in the water line down stream of the mixing of hot and cold water for the shower, the blocking valve moveable between at least i) a closed position in which the mixed hot and cold water stream is prevented from exiting the shower head, and ii) an open position in which the mixed hot and cold water stream is substantially unimpeded by the blocking valve from flowing to the shower head;

B) a wireless controller communicating with the blocking valve and configured to send signals to the blocking valve to move the valve at least between the open and the closed positions;

C) at least one other independent controller for moving the blocking valve at least between the open and the closed positions;

D) a digital temperature sensor mechanism positioned within the water line down stream of the mixing of hot and cold water for the shower and configured to measure the temperature of water flowing in the water line; and E) a temperature indicating mechanism communicating with the digital temperature sensor mechanism and indicating to the user at least one measured temperature of the water when the blocking valve is not in the closed position, the temperature indicating mechanism comprising:

i) a visible display on at least one wireless controller; and ii) an audible indicator on at least one wireless controller that are adapted to convey when the measured temperature of the water reaches an acceptable steady state temperature at least when the valve is in the open position, wherein said at least one other controller for moving the blocking valve at least between the open and the closed positions is a second, independent wireless controller, and wherein the valve is further moveable to a trickle flow position in which the mixed hot and cold water stream is substantially, but not completely, impeded by the blocking valve from flowing to the shower head wherein water continues to flow in an amount sufficient for the digital temperature sensor mechanism to obtain an accurate temperature reading of the flowing water, and wherein the digital temperature sensor mechanism will send a signal to the blocking valve to move the valve to the trickle flow position in response to a measured temperature of the water above a preset maximum temperature value at least when the valve is in the open position.

6. The shower actuator according to claim 5 wherein said at least one other controller for moving the blocking valve at least between the open and the closed positions is a second, independent wireless controller.

7. The shower actuator according to claim 5 further including a digital temperature sensor mechanism positioned within the water line down stream of the mixing of hot and cold water for the shower and configured to measure the temperature of water flowing in the water line, and wherein at least one controller includes a visible display in communication with the digital temperature sensor mechanism adapted to continuously display the measured temperature of the water at least when the valve is in the open position.

8. The shower actuator according to claim 5 further including a digital temperature sensor mechanism positioned within the water line down stream of the mixing of hot and cold water for the shower and configured to measure the temperature of water flowing in the water line, wherein the valve is further moveable to a trickle flow position in which the mixed hot and cold water stream is substantially but not completely impeded by the blocking valve from flowing to the shower head wherein water continues to flow in an amount sufficient for the digital temperature sensor mechanism to obtain an accurate temperature reading of the flowing water, and wherein the digital temperature sensor mechanism will send a signal to the blocking valve to move the valve to the trickle flow position in response to a measured temperature of the water above a preset maximum temperature value at least when the valve is in the open position.

9. A shower actuator for a shower having a shower head in a water line that is downstream of hot and cold water mixing for the shower, the shower actuator comprising:

A) a digital temperature sensor mechanism positioned within the water line down stream of the mixing of hot and cold water for the shower and configured to measure the temperature of water flowing in the water line;

B) a battery powered blocking valve configured to be placed in a shower down stream of the mixing of hot and cold water for the shower, the blocking valve moveable between at least i) a closed position in which the mixed hot and cold water stream is prevented from exiting the shower head, ii) an open position in which the mixed hot and cold water stream is substantially unimpeded by the blocking valve from flowing to the shower head, and iii) a trickle flow position in which the mixed hot and cold water stream is substantially but not completely impeded by the blocking valve from flowing to the shower head wherein water continues to flow in an amount sufficient for the digital temperature sensor mechanism to obtain an accurate temperature reading of the flowing water, and wherein the digital temperature sensor mechanism will send a signal to the blocking valve to move the valve to the trickle flow position in response to a measured temperature of the water above a preset maximum temperature value; and C) at least one controller for moving the blocking valve at least between the open and the closed positions.

10. The shower actuator according to claim 9 further including a temperature indicating mechanism communicating with the digital temperature sensor mechanism and indicating to the user at least one measured temperature of the water when the blocking valve is not in the closed position.

11. The shower actuator according to claim 10 wherein at least one controller is a wireless controller, and the temperature indicating mechanism includes at least one of i) a visible display on at least one wireless controller and ii) an audible indicator on at least one wireless controller that are adapted to convey when the measured temperature of the water reaches an acceptable steady state temperature at least when the valve is in the open position.

12. The shower actuator according to claim 9 where said at least one controller includes at least one wireless controller communicating with the blocking valve and configured to send signals to the blocking valve to move the valve at least between the open and the closed positions.

13. The shower actuator according to claim 9 wherein said at least one controller includes a pair of independent wireless controllers, each independent wireless controller communicating with the blocking valve and configured to send signals to the blocking valve to move the valve at least between the open and the closed positions.

14. The shower actuator according to claim 13 further including a temperature indicating mechanism communicating with the digital temperature sensor mechanism and wherein the temperature indicating mechanism includes a visible display on at least one wireless controller adapted to continuously display the measured temperature of the water at least when the valve is in the open position.

15. The shower actuator according to claim 9 further including a temperature indicating mechanism communicating with the digital temperature sensor mechanism and wherein the temperature indicating mechanism includes a visible display on at least one controller adapted to continuously display the measured temperature of the water at least when the valve is in the open position.

* * * * *